US006248445B1

(12) United States Patent
Yamakawa et al.

(10) Patent No.: US 6,248,445 B1
(45) Date of Patent: Jun. 19, 2001

(54) COMPOSITE FILAMENT YARN AND PROCESS AND SPINNERET FOR MANUFACTURING THE SAME

(75) Inventors: Yukio Yamakawa, Hofu; Soichiro Tanaka, Suita; Koji Itonaga; Yasushi Nakai, both of Hofu, all of (JP)

(73) Assignee: Kanebo, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/308,639

(22) Filed: Sep. 19, 1994

Related U.S. Application Data

(63) Continuation of application No. 07/460,673, filed on Jan. 4, 1990, now abandoned.

(30) Foreign Application Priority Data

Jan. 12, 1989 (JP) ..... 1-5299
Dec. 15, 1989 (JP) ..... 1-324089
Dec. 20, 1989 (JP) ..... 1-328213

(51) Int. Cl.[7] ..... D02G 3/00
(52) U.S. Cl. ..... 428/373; 428/374; 428/397
(58) Field of Search ..... 428/373, 374, 428/397, 370; 57/243; 264/171

(56) References Cited

U.S. PATENT DOCUMENTS 3,607,611 9/1971 Matsui et al. ..... 161/173
3,987,141 * 10/1976 Martin ..... 428/373
4,106,313 8/1978 Boe .

FOREIGN PATENT DOCUMENTS

780597 * 3/1968 (CA) ..... 428/373 X
2 032 912 1/1971 (DE) .
1292301 10/1972 (GB) .
1427889 3/1976 (GB) .
1 518 500 7/1978 (GB) .
49-10283 3/1974 (JP) .
49-36916 4/1974 (JP) .
55-9093 3/1980 (JP) .
55-22570 6/1980 (JP) .
55-27175 7/1980 (JP) .
55-36725 9/1980 (JP) .
61-132627 * 6/1986 (JP) ..... 428/373
62-156314 7/1987 (JP) .
63-175118 7/1988 (JP) .
63-256719 10/1988 (JP) .

OTHER PUBLICATIONS

Japan 63–256719, published Oct. 24, 1988; abstract only.

* cited by examiner

*Primary Examiner*—Cynthia Harris
*Assistant Examiner*—J. M. Gray
(74) *Attorney, Agent, or Firm*—Flynn, Thiel, Boutell & Tanis, P.C.

(57) ABSTRACT

A polyamide/polyurethane composite filament yarn, contains a filament having a polyamide sheath component and a polyurethane eccentric core component exposed, through a neck portion of uniform width, on the surface of the filament. The filament is manufactured by a process comprising inserting, immediately before extruding from a spinneret orifice, a molten polyurethane flow, at an oblique angle from above, into a molten polyamide flow flowing down in a conduit, so that a small part of the polyurethane flow radially projects in a restricted width through the thinnest portion of the polyamide flowing flows down the inner wall of the conduit. For this process, an employable spinneret comprises a leading duct for a polyamide connected to an orifice via a vertical conduit, another leading duct for a polyurethane connected to an injection pipe obliquely extending therefrom, protruding into said conduit, opening immediately before said orifice and having a slit extending longitudinally at its under side along its entire protruded length.

7 Claims, 2 Drawing Sheets

COMPOSITE FILAMENT YARN AND PROCESS AND SPINNERET FOR MANUFACTURING THE SAME

This application is a continuation of U.S. Ser. No. 07/460 673, filed Jan. 4, 1990; now abandoned.

BACKGROUND OF THE INVENTION

1. Field of the Invention

The present invention relates to polyamide/polyurethane composite filament yarns having a crimpability, a process and a spinneret for manufacturing the same and hosiery, such as stockings or the like, knitted therewith.

2. Related Art Statement

It is known that composite filaments consisting of polyamide and polyurethane components conjugated eccentrically with each other in a unitary filament have an excellent crimpability (Japanese Patent Application Publication Nos. Sho-55-22,570 and 55-27,175). However, side-by-side type composite filaments, for example, such as shown in FIG. 4, though excellent in crimpability, have a drawback such that separation of the components and deterioration of physical properties are caused by bending or abrasion during processing steps or wearing of textile articles composed of such filaments, due to insufficient compatibility of both components. Another drawback is polyurethane components exposed on the surface of the filament stick to each other due to retarded solidification of polyurethane melt, so that as-spun and wound filament yarns cannot be unwound from a yarn package due to sticking.

Alternatively, whereas sheath and kidney-like core type composite filaments as shown in FIG. 5 which have been proposed, for example, in Japanese Patent Application Publication No. Sho-55-27,175, have solved the problems presented by the side-by-side type composite filaments, such filaments still have a drawback that crimp developability, by virtue of difference in shrinkage between a high shrinking polyurethane component and a low shrinking polyamide component, is poor because the polyurethane core component is completely surrounded with the polyamide sheath component.

Further, even with the combination of a polyamide component with a polycarbonate based polyurethane component, which has relatively good compatibility, the adhesiveness between these components are still insufficient, so that there occurs a phenomenon such that two components split during the yarn manufacturing process or the wearing of stockings, or the like. For example, in sheath and kidney-like core type composite filaments as shown in FIG. 5, external stresses, such as elongation, bending, abrasion, heat treatment, or the like, concentrate on thin edge portions, $C_1$~$C_2$ and $C_1'$~$C_2'$, where the sheath eventually breaks and the two components separate from each other along the line $C_1$~$C_1'$.

Therefore, in order to solve the problems of poor adhesiveness of two components, inferior abrasion resistance of articles and sticking of polyurethane components to each other, which include polyamide/polyurethane side-by-side type composite filament yarns, we, the inventors, have proposed in Japanese Patent Application Laid-open No. Sho-63-256,719, as composite filaments having an excellent crimpability, as compared with the above-mentioned sheath and kidney core type composite filaments, composite filaments as shown in FIG. 6 wherein a large part of a polyurethane component is surrounded with a polyamide component and a small part of the polyurethane component is exposed on the surface of the filament, and a process for spinning such composite filaments with a spinneret as shown in FIG. 2. Namely, the spinneret shown in FIG. 2 comprises a vertical conduit 2 extending from a polyamide leading duct 1, having an orifice 3 of small diameter opening downwards, and an injection pipe 5 extending obliquely downwards from a polyurethane leading duct 4, having a tip end portion protruding into said conduit 2. The degree of protrusion is adjusted to an extent that the inner circumference of the opening tip end of the injection pipe 5 is just tangent internally to the inner circumference of the conduit 2. With such a spinneret, incomplete sheath and core type composite filaments as shown in FIG. 5 are obtained, wherein a polyurethane component, B tangent internally to a polyamide component A, is barely exposed at the contact point on the surface of the filament.

In the cross-sectional shape of such a filament, the polyamide component A surrounds most of the polyurethane component and gradually decreases its thickness along its periphery, so that stress concentration as aforementioned is relaxed and excellent adhesion is obtained between the polyamide and polyurethane components. This stops both components from splitting easily and sticking of polyurethane components to each other can be prevented between asspun filament yarns wound on a take-up roll.

However, whereas the above-mentioned composite filaments proposed by the present inventors, provided with excellent physical properties, have succeeded in obviating all of the aforementioned prior art difficulties, these filaments have been found to have another drawback such that when the spinning is conducted with the above-mentioned spinneret, the cross-sectional shape of the filament, particularly the width d in FIG. 6 of the exposed polyurethane component, largely varies due to the fluctuation of melt viscosity caused by a slight temperature variation.

Further, both the side-by-side type and sheath and kidney-like core type filaments have a problem of fisheyes caused by a poor stability of the polyurethane melt during spinning.

By fisheye is meant a local thick portion in drawn filament after spinning, winding and drawing, which causes poor draw-twisting operability of undrawn filament yarns as well as inferior qualities of articles, such as stockings, composed of the filament yarns.

Throughout this specification, the number of fisheyes is a value obtained by counting thick portions having a diameter five times the normal diameter of the unitary filament constituting a drawn yarn and converting the count to the number per 1 kg of a filament yarn.

SUMMARY OF THE INVENTION

The first object of the present invention is to constantly provide uniform, incomplete sheath and core type composite filaments consisting of a polyamide and a polyurethane, with excellent physical properties, such as crimpability, abrasion resistance or the like, and which exhibit a good processability with a restrained stickiness of undrawn yarns.

The second object is to largely reduce fisheyes of drawn yarns by passing a polyamide/polyurethane composite polymer through a constriction in a nozzle to effect fluid orientation.

A process for manufacturing composite filaments according to the present invention is, in spinning by extruding molten polyamide and polyurethane components simultaneously from a spinneret orifice through a vertical conduit, characterized in that a molten polyurethane component flow is inserted obliquely from a upper direction and incorporated eccentrically into a molten polyamide component flow flowing down in said conduit, while a small part of said polyurethane component flow radially projected in a restricted width, penetrates through the thinnest portion of said polyamide component flow and flows down along the inner wall of said conduit, immediately before being extruded from said spinneret orifice.

In the above manufacturing process, it is preferred that said polyamide component has a relative viscosity of 2.0~2.6 as determined with a 10 mg/ml solution in 95.7% sulfuric acid and said polyurethane component has a melt viscosity at 210° C. of 20,000~50,000 poise.

The above manufacturing process is preferred to further comprise passing the incorporated molten polymer components successively through a constriction and an expanded conduit before extrusion.

The spinneret of the invention to be used for conducting the above manufacturing process is characterized by a leading duct for the polyamide component connected to an orifice via a vertical conduit, another leading duct for the polyurethane component connected to an injection pipe obliquely extending therefrom and penetrating and protruding into said conduit, opening immediately above said orifice and having a slit extending longitudinally at its under side along the entire protruded length.

The above injection pipe is preferred to have an inside diameter of 30~80% of that of the conduit.

Further, said slit is preferred to have, in its projected figure on a horizontal plane, a length of 2~20% of the inside diameter of said conduit and a width of 0.2~10% of the circumference of said conduit.

The spinneret of the invention preferably has a constricted portion between an opening level of the injection pipe and the orifice. This constricted portion is preferred to have a ratio of the length L to the bore diameter D in the range defined by the following equation:

$$L/D=1.0\sim3.0$$

In the spinneret of the invention, the conduit preferably expands divergently from the constricted portion towards the orifice.

Further, it is preferred that the constricted portion has a bore diameter in the range of 0.20~0.45 mm, preferably 0.25~0.40 mm, and the orifice has an opening diameter in the range 0.5~0.7 mm.

The above-described process and spinneret can provide a composite filament yarn of the invention comprising a polyamide sheath component and polyurethane core component arranged eccentrically in said polyamide sheath component in the cross-section of a unitary filament, which is characterized in that the polyurethane core component is exposed substantially in a uniform width on the surface of the filament via a polyurethane neck portion which penetrates a thin portion of said polyamide sheath component to the surface of the filament.

In the above composite filament yarn, the polyurethane core component is preferred to be exposed substantially in a uniform width between 2% and 25%, preferably between 3% and 15%, of the circumference of the filament.

In a preferred embodiment of the composite filaments of the present invention, said exposed width has a standard deviation of not exceeding 2.0%, ideally not exceeding 1.6%, of a mean value.

Further, the composite filaments of the invention are preferred to have a cross-sectional shape of the polyamide sheath component wherein a thin portion having a thickness of not more than 1/20 of the diameter of the composite filament, extends by a width of not exceeding 1/5, preferably 1/10, of the diameter of the composite filament, and terminates suddenly reducing its thickness. With such a shape, it is easy to maintain a uniform exposed width of the polyurethane core component.

The conjugate ratio of the polyamide and polyurethane components is preferably 40/60~80/20, more preferably 45/55~70/30, by volume.

The above preferred embodiment of the process and spinneret of the invention can provide composite filament yarns having not more than 1,000 fisheyes/kg, preferably not more than 500 fisheyes/kg after drawing.

BRIEF DESCRIPTION OF THE DRAWINGS

The present invention will be explained in more detail hereinafter by way of example with reference to the appended drawings.

DESCRIPTION OF THE PREFERRED EMBODIMENTS

Figure 1:
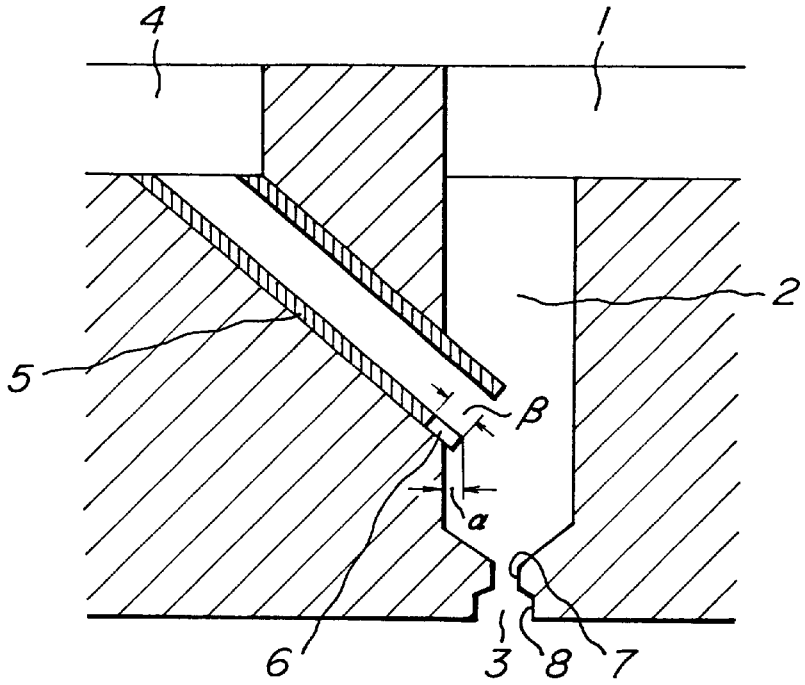
FIG. 1 is a schematic vertical cross-sectional view illustrating a spinneret of the invention to be employed in the process of the present invention.

Referring to FIG. 1, a molten polyamide component is supplied from a polyamide leading duct 1 into a vertical conduit 2 and then extruded from a spinneret orifice 3. A molten polyurethane component is supplied from a polyurethane leading duct 4 and injected through an injection pipe 5 into the conduit 2. This injection pipe 5 extends obliquely from the duct 4, penetrates and protrudes into the conduit 2 and opens immediately before the orifice 3. The inside diameter of the injection pipe 5 is in the range of between 30% and 80% of the inside diameter of the conduit, depending upon the conjugate ratio the components. Additionally, in order to dispose the polyurethane component with an appropriate eccentricity to provide a resulting composite filament yarn with a good crimpability, the length of the protrusion and the slanting angle of the injection pipe 5 may be adequately selected so that, in the projected figure on a horizontal plane of the pipe, the inner circumference at the tip end opening of the pipe may reach a distance of about 1/2~3/4 of the diameter of the conduit 2 and the projected length $\alpha$ of the generating line at the under side of the inner periphery of the pipe may be about 2~20% of the diameter of the conduit 2.

One of the most important features of the spinneret according to the present invention is that the injection pipe 5 is provided at its under side with a slit 6 extending along the entire length $\beta$ of its portion that protrudes into the conduit. Here, by the under side is meant a portion along a lower generating line in a vertical plane including the longitudinal axis of the pipe. If the position of the slit deviates from the under side, disposition of a neck portion as will be illustrated hereinafter that is formed by the slit also deviates from the thinnest portion of the polyamide sheath, so that the crimpability of the resulting composite filament yarns will be undesirably deteriorated. Further, the slit 6 is preferred to have a width of about 0.2~10% of the circumference of the conduit 2. If the width is less than 0.2%, the objective cross-sectional conjugate shape cannot be obtained and a core and complete sheath type may be formed. Alternatively, the width should not exceed 10.0%, because when it exceeds 10.0%, the polyurethane component is exposed so excessively on the surface of the filament that drawbacks of side-by-side type composite filament yarns, such as poor abrasion resistance and intense stickiness of wound undrawn yarns, will appear.

By applying such an injection pipe, the polyurethane component flow is incorporated, with appropriate conjugate ratio and eccentricity, into the polyamide component flow flowing down in the conduit 2, while a part of the polyurethane component flow which is radially projected in a restricted width and penetrates through the thinnest portion of said polyamide flow up to the inner wall of the conduit flows down from the above-described slit 6 along the inner wall of the conduit 2. The projected part of the polyurethane core component is interposed between two split thin portions of the polyamide sheath component. The thus conjugated polymer flow is spun from the orifice 3 to form a composite filament. In this case, since the injection pipe is positioned to open its protruded portion into a level of the conduit 2 immediately above the orifice, the relative arrangement of both components is preserved in the spun filament substantially without being disturbed.

The spinneret to be employed in the present invention is preferred to have a constricted portion 7 in the conduit for the polyamide/polyurethane conjugated flow to pass through. The constricted portion is most preferred to have a ratio of the length L to the bore diameter D in the range defined by the following equation:

$$L/D=1.0\sim3.0$$

Further, the constricted portion through which the polyamide/polyurethane conjugated flow passes is preferred to have a bore diameter in the range of 0.20~0.45 mm, preferably 0.25~0.40 mm, and the conduit after the constricted portion to the orifice is preferred to expand like a trumpet 8 having an opening diameter in the range of 0.5~0.7 mm. The conjugated molten polyamide/polyurethane components flowing through the constricted portion of 0.20~0.45 mm diameter are fluid oriented whereby fisheyes of the composite filament yarns can be largely reduced. Thus, no more than 1,000 fisheyes, preferably no more than 500 fisheyes, per 1 kg of yarn, are counted in the composite filament yarn of the present invention produced with the spinneret having the constriction, while no less than about 2,000 fisheyes per 1 kg of yarn are counted in the conventional yarns. If the bore diameter of the constricted portion 7 exceeds 0.45 mm, the fisheye restraining effect becomes insufficient. Alternatively, if it is less than 0.20 mm, a pressure loss at the constricted portion is too large to adapt the spinneret to practical operation.

Furthermore, the divergent trumpet-like conduit formed after the constriction can mitigate, by virtue of a stress relaxing function, a kneeing phenomenon (bending of the extruded polymer immediately after spinning) and prevent filament breakage due to deposition of polymer decomposition products on the rim of the orifice.

Figure 3:
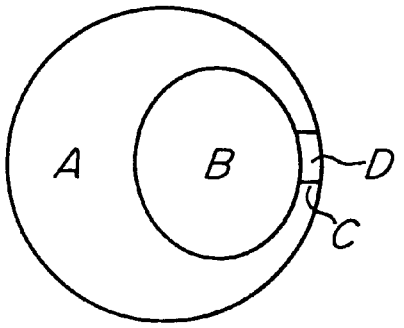
FIG. 3 is a cross-sectional view showing the arrangement and shape of the composite filament of the present invention.

In FIG. 3, showing a cross-section of the thus formed composite filament, a polyurethane core component B is disposed, with adequate conjugate ratio and eccentricity, in a polyamide sheath component A and the polyurethane core component is uniformly exposed on the surface of the filament by a polyurethane neck portion D penetrating the thinnest portion C of said polyamide sheath component A.

By selecting appropriately the dimension and arrangement of the above-described injection pipe, the exposed width of the neck portion D on the surface of the filament becomes substantially uniform in the range of between 2% and 25%, preferably between 3% and 15%, of the circumference of the filament. If the exposed width is smaller than the above range, the crimpability becomes insufficient, while if the exposed width is too large, it is not preferred because there is apt to appear an ill effect of stickiness as well as deterioration of abrasion resistance due to separation of the two components.

By virtue of formation of the neck portion D by the aforementioned injection pipe, the shape and exposed width of the neck portion are made uniform and the variation thereof due to influence of temperature condition change or the like becomes extremely small, so that the variation of the exposed width is restrained in a standard deviation about a mean value of not more than 2.0%, in a preferred embodiment not more than 1.6%, within a lot of the same specification, not to mention in the same filament.

Accordingly, uniform polyamide/polyurethane composite filament undrawn yarns with reduced stickiness can be obtained and knit operability of these yarns is improved, whereby knitted goods of excellent qualities can be obtained with largely decreased knitting defects such as barré or the like.

The conjugate ratio of the polyamide component to the polyurethane component is preferably within the range of 40/60~80/20, more preferably 45/55~70/30, by volume. Satisfactory crimp properties are obtained in the above range.

Preferable polyamides applicable to the present invention are poly-ϵ-capramide and copolymers thereof containing not more than 30 mole % of copolymerizable component. Of course, other known polyamides, such as polyhexamethylene adipamide, copolymers thereof, blend polymers thereof, or the like, can be applied.

Suitable polyurethanes applicable to the present invention are thermoplastic polyurethane elastomers having a hardness of 90~100, determined in accordance with JIS K-6301 and the testing method of Shore hardness (A-type). As an example, mention may be made of polyester based polyurethanes, polycaprolactone based polyurethanes, polycarbonate based polyurethanes, or the like. Polyurethanes having a hardness of less than 90 are difficult to balance the melt viscosity with polyamides (difficult to spin with stability), while polyurethanes having a hardness of exceeding 100 are apt to be low in elastic recovery.

Polyurethane elastomers given a crosslinkage structure in molecules by melt-blending a polyisocyanate compound prior to conjugate spinning, are also preferred for their excellent heat resistance, crimpability and compatibility with polyamides.

Additionally, from the viewpoint of stickiness, the more preferable polyurethanes are polycarbonate based polyurethanes, most preferably polyurethanes comprising soft segments of polycarbonate/polyester blend (the blend ratio of the two components being 8/2~4/6).

It is preferred that the polyamide components to be applied to the process according to the present invention has a relative viscosity within the range of 2.0~2.6, determined with 10 mg/ml solution in 95.7% sulfuric acid, while the polyurethane components have a melt viscosity of 20,000~50,000 poise, determined with a flow-tester at 210° C. If the viscosity difference decreases beyond the above range, a satisfactory crimpability cannot be assured, while if the viscosity difference is too large, stabilized spinning operation may possibly be impeded due to the aforementioned kneeing phenomenon.

The spun filament yarn is taken up on a bobbin after solidification by quenching, and then the wound as-spun yarn is drawn at an appropriate draw ratio and further subjected to heat treatment, etc., followed by winding on a pirn, according to the conventional process. Alternatively, after melt-spinning and quenching, the as-spun yarn is, without being taken-up on a roll, subjected to direct drawing or heat treatment. The present invention includes both of the above processes.

The polyamide/polyurethane composite filament drawn yarns according to the invention are preferred to have a shrinkage in boiling water of generally 5~30%, more preferably 7~25%. If it exceeds 30%, the yarns excessively shrink in the heat treatment process after knitting, so that short sized knitted goods are yielded, while if the shrinkage is less than 5%, sufficient crimps do not develop in the heat treatment process after knitting and the articles such as stockings will lack in stretchability.

The heat treatment is preferred to be conducted continuously at a relax ratio slightly larger than the shrinkage in boiling water determined with drawn yarns. When the relax ratio during a relax heat treatment is smaller than the shrinkage in boiling water of drawn yarns, the wound yarns develop feeble crimps, while in the case where the heat treatment is conducted at a relax ratio fairly larger than the shrinkage in boiling water, the heat-treated yarns develop ripple-like fine crimps like an elongated spring.

As a relax heat treatment, there may be a process of heating the yarns traveling through a tube heater with air as a heating medium, a process of hot plate heat treatment wherein the yarns travel on a plate heater, or the like.

Composite filament yarns according to the present invention are desirably composed of 1~10 constituent filaments of 3~30 d and have a total fineness of 5~50 d. In particular, as material yarns for stockings which require transparency, it is desired that the total fineness is in the range of 5~30 d and the number of the constituent filaments is in the range of 1~6. If the unitary filaments constituting the yarn have a fineness of less than 3 d, the stockings show an insufficient durability when they are worn. While if more than 30 d, the stockings will have stiff pool. Further, the stockings in the present invention include all of the overknee stockings, full length stockings and panty hoses.

In the case of core and incomplete sheath type composite filaments wherein a polyurethane core component is disposed at the eccentric extremity in cross-section and barely exposed on the surface of the filament, the exposed width is largely varied by a slight change of conditions, as described hereinbefore, resulting in uneven crimp properties, posing a problem of low abrasion resistance and causing local stickiness due to exposed polyurethane components. In contrast, the composite filament yarns of the present invention, since the neck portion has a width evenly stabilized in appropriate size, particularly excel in crimp properties, durability and processability. Further, defects of knitted goods, such as barré or the like, decrease largely, whereby knitted goods having excellent qualities can be obtained.

Furthermore, according to the preferred embodiment of the manufacturing process of the invention, there can be obtained polyamide/polyurethane composite filament drawn yarns having excellent crimp properties and abrasion resistance as well as improved processability and good quality with largely decreased fisheyes. The composite filaments of the present invention can be used alone or in combination with other kinds of fibers, such as polyamide fibers, cotton fibers, polyurethane core covering yarns or the like, according to conventional processes, such as doubling, ply-twisting, intermingling, mix-knitting, mix-weaving or the like. Thus, the composite filament yarns of the invention are suitable for textile products, such as stockings, tights, ladies' lingerie and foundation garments or the like.

The present invention will be further illustrated in more detail by way of example.

In the examples and comparative examples, shrinkage percentage, stretch percentage and abrasion resistance, which represent the crimp property, are determined according to the following methods:

An undrawn yarn is drawn and heat-treated in a relaxed state and formed into a skein about 56.25 cm long. Its length, when a load of 0.2 g/d is applied thereto, is the initial length $l_0$. Then a load of 1 g is applied and a crimp developing treatment is conducted in boiling water for 10 minutes. After standing overnight, the length $l_1$ is determined as the 1 g load is attached. The shrinkage percentage is found according to the following equation (1):

$$\text{Shrinkage percentage } (\%)=(l_0-l_1)/l_0\times 100 \quad (1)$$

Similarly, a sample in the form of a skein has a load of 250 mg applied thereto and is treated in boiling water for 10 minutes followed by standing overnight and then the initial length $l_2$ is determined. Further, after applying a load of 0.2 g/d, the length $l_3$ is determined. The stretch percentage is found according to the following equation (2):

$$\text{Stretch percentage } (\%)=(l_3-l_2)/l_2\times 100 \quad (2)$$

The yarn after drawing and heat treatment in a relaxed state is circular knitted. After continuously repeating abrasion with a load of 1 kg, separation of the two components on the surface of the knitted goods is microscopically observed and evaluated.

Grade 3: no separation observed after 3,000 cycle abrasion.

Grade 4: no separation observed after 5,000 cycle abrasion.

The quality of the knitted goods is evaluated by observing barré defects of the circular knit which is knitted at a rotation rate of 600 r.p.m. with a usual tubular knitting machine having 4 feeders (400 needles) and then heat-treated in a relaxed state in boiling water to develop crimps.

EXAMPLE 1

Nylon-6 having a relative viscosity of 2.35 and a polycarbonate based polyurethane having a melt viscosity at 210° C. of 32,000 poise and a Shore A hardness of 95 were separately melted and then metered separately at a volume ratio of 50:50. The molten two polymers were conjugate spun, at a take-up speed of 500 m/min., from a spinneret for conjugate spinning as shown in FIG. 1, to form an undrawn yarn of 55 d/2 f. The spinneret for conjugate spinning used therefor had a conduit of 2 mm I.D. and a polyurethane injection pipe of 1 mm I.D. and 1.26 mm O.D. The conduit and the polyurethane injection pipe made an angle of 35° and the distance between the lowest point of the inner circumference of the tip end opening of the pipe and the nearest inner wall of the conduit ($\alpha$ in FIG. 1) was 0.16 mm. Further, the length of a slit at the under side of the injection pipe ($\beta$ in FIG. 1) was 0.4 mm and the width of the slit was varied into 6 sizes as follows:

Width of the slit (mm):0.01, 0.02, 0.10, 0.30, 0.50 and 0.70.

Then, 6 kinds of taken-up undrawn yarns were drawn and heat-treated in a relaxed state, and 6 kinds of composite filament yarns of 17 d/2 f, $Y_1$, $Y_2$, $Y_3$, $Y_4$, $Y_5$ and $Y_6$, were obtained.

On the other hand, spinning, drawing and relax heat treatment were conducted under the same conditions as above except that the conjugate spinning spinneret was a conventional side-by-side type, and a side-by-side type composite filament yarn $Y_7$ was obtained.

With respect to the state of spinning of the composite filament yarns $Y_1$~$Y_6$, the melt being extruded from the spinneret orifice was substantially perpendicular to the spinneret face and no kneeing phenomenon was observed. In contrast, when the spinneret for side-by-side type conjugate spinning was used, the kneeing phenomenon was observed in the composite filament yarn $Y_7$ which bent forming an angle of about 140° with the spinneret face.

Figure 2:
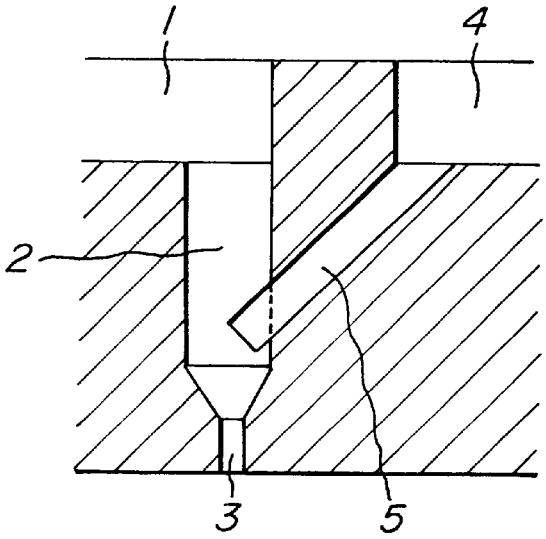
FIG. 2 is a schematic vertical cross-sectional view illustrating a conventional spinneret.
Figure 6:
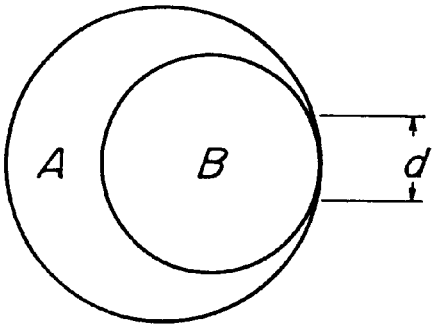
FIG. 6 is a cross-sectional view showing a known core and incomplete sheath type composite filament.

Additionally, as a comparative example, spinning, drawing and relax heat treatment were conducted under the same conditions as above except that a conjugate spinning spinneret as shown in FIG. 2 was used, and a core and incomplete sheath type composite filament yarn $Y_8$ as shown in FIG. 6 was obtained.

The microscopically observed cross-sectional shapes and yarn properties of these composite filament yarns $Y_1$~$Y_8$ are shown in Table 1.

TABLE 1

| | Item | | | | | | | |
|---|---|---|---|---|---|---|---|---|
| | Width | Polyurethane Exposed Width (%) | | Crimp Property | | Abrasion Resistance | Sticking of | Barré of |
| Sample | of Slit (mm) | Mean Value | Standard Deviation | Stretch (%) | Shrinkage (%) | 1 Kg × 3000 cycle | Undrawn Yarn | Circular Knit |
| Comparative $Y_1$ | 0.01 | 0 | — | 140 | 60.2 | ○ | ○ | ○ |
| Invention $Y_2$ | 0.02 | 3 | 0.5 | 180 | 66.1 | ○ | ○ | ○ |
| Invention $Y_3$ | 0.1 | 10 | 0.7 | 198 | 68.3 | ○ | ○ | ○ |
| Invention $Y_5$ | 0.3 | 15 | 1.0 | 230 | 69.5 | ○ | ○ | ○ |
| Invention $Y_5$ | 0.5 | 25 | 1.3 | 233 | 70.3 | Δ | ○ | ○ |
| Comparative $Y_6$ | 0.7 | 30 | 1.7 | 250 | 72.0 | X | X | Δ |
| Comparative $Y_7$ | — | 47 | 3.4 | 261 | 73.2 | X | X | X |
| Comparative $Y_8$ | — | 11 | 2.1 | 220 | 69.0 | ○ | ○ | X |

As shown in Table 1, all of the composite filament yarns $Y_2$~$Y_5$ according to the present invention had a cross-sectional shape of unitary filament wherein a polyurethane core was almost lapped in a polyamide sheath. Exposed on the surface of the filament was a neck portion having a uniform width of within 25% of the circumference of the filament. Additionally, the filament yarns of the invention showed good results in crimp properties, abrasion resistance and sticking of undrawn yarns.

In contrast, the conjugate spinning spinneret provided with an injection pipe having a slit 0.01 mm wide, produced a core and complete sheath type composite filament yarn $Y_1$. Whereas the yarn $Y_1$ was good in abrasion resistance and sticking of undrawn yarns, it showed poor crimp properties. Alternatively, the composite filament yarn $Y_6$ produced with the spinneret provided with an injection pipe having a slit 0.7 mm wide, had a polyurethane neck portion having an exposed width of more than 25% of the circumference of the filament. This yarn $Y_6$ was poor in abrasion resistance and showed sticking of undrawn yarns. Alternatively, the composite filament yarn $Y_7$ produced with the conventional side-by-side conjugate spinning spinneret, had a polyurethane component exposed width mean value of 47% of the circumference of the filament with a standard deviation about the mean value of 2.0%. This yarn $Y_7$ had good crimp properties and, however, bad sticking of undrawn yarn. Circular knitted goods knitted therewith had an inferior quality due to many barré. Alternatively, the comparative example yarn $Y_8$ had a polyurethane exposed width mean value of 11% of the circumference of the filament with a standard deviation of more than 2.0%. This yarn $Y_8$ was good in crimp properties, sticking property and abrasion resistance and, however, circular knitted goods knitted therewith had an inferior quality due to many barré.

EXAMPLE 2

Nylon-6 having a relative viscosity of 2.35 and a polyurethane comprising soft segments of a blend polymer of polycarbonate and poly-1,6-hexane adipate (blend ratio of 7/3) were conjugate melt-spun with a spinneret same as that used in spinning of the yarn $Y_3$ in Example 1 except that the diameter of the orifice was 0.50 mm and a constricted portion was provided. Changing the diameter of the constricted portion, seven kinds of composite filament yarns $Y_9$~$Y_{14}$ of the present invention were obtained.

Figure 5:
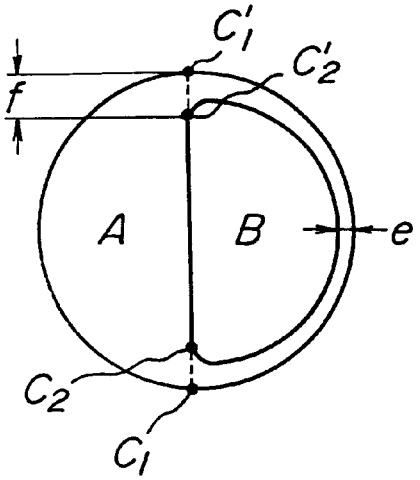
FIG. 5 is cross-sectional view showing a conventional kidney core and complete sheath type composite filament.

Comparative example yarn $Y_{15}$ was a conventional, eccentric kidney-like core and complete sheath type composite filament as shown in FIG. 5, wherein the conjugate ratio of polyamide to polyurethane was 1/1 in area.

Figure 4:
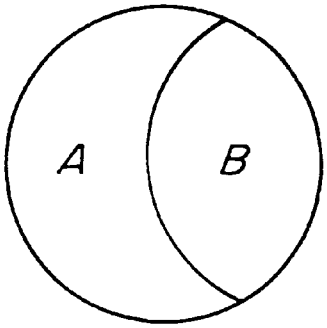
FIG. 4 is a cross-sectional view showing a conventional side-by-side type composite filament.

A conventional side-by-side type composite filament yarn $Y_{16}$ as shown in FIG. 4 was obtained in the same manner as the yarn $Y_{12}$ of the present invention excepting the conjugate figure.

Further, as a comparative example, a polyamide/polyurethane composite filament yarn $Y_{17}$ was obtained in the same manner except that a conjugate spinning spinneret without the constricted portion was used.

Then, with a drawing machine provided with a plate heater 20 cm long between 2 rolls (the first roll is heated), the as-spun yarns were drawn on the plate heater at a drawing speed of 400 m/min. and a draw ratio of 3.50. Then, the drawn yarns were heat-treated into a relaxed state with a relax heat treatment apparatus provided with a plate heater between 2 rolls and composite filament yarns of 20 d/2 f were obtained. The appearance of the yarn packages of these resulting composite yarns showed slack, wavy crimps developed. The crimp figure did not change maintaining the slack, wavy crimps, when the yarns were unwound from the yarn package.

The manufacturing conditions and yarn properties of the drawn yarns obtained from the composite filament yarns according to Examples and Comparative Examples are shown in Table 2.

TABLE 2

| | Item | | | | | | | |
|---|---|---|---|---|---|---|---|---|
| | | Diameter | Crimp Property | | Abrasion | | | Sticking of |
| Sample | Conjugate Figure | Contriction (mm) | Stretch (%) | Shrinkage (%) | Resistance (Grade) | Fisheye | Pressure Loss | Undrawn Yarn |
| Invention $Y_9$ | FIG. 3 | 0.45 | 220 | 67 | 4 | 970 | 105 | ○ |
| Invention $Y_{10}$ | " | 0.40 | 228 | 66 | " | 720 | 110 | ○ |
| Invention $Y_{11}$ | " | 0.35 | 225 | 67 | " | 330 | 140 | ○ |
| Invention $Y_{12}$ | " | 0.30 | 226 | 68 | " | 250 | 160 | ○ |
| Invention $Y_{13}$ | " | 0.25 | 222 | 67 | " | 140 | 180 | ○ |
| Invention $Y_{14}$ | " | 0.20 | 220 | 67 | " | 90 | 230 | ○ |
| Comparative $Y_{15}$ | FIG. 5 | 0.30 | 198 | 60 | " | 270 | 170 | ◎ |
| Comparative $Y_{16}$ | FIG. 4 | 0.30 | 250 | 71 | 3 | 240 | 150 | X |
| Comparative $Y_{17}$ | FIG. 3 | 0.50 | 217 | 66 | 4 | 2600 | 100 | ○ |

As is seen from Table 2, the fisheyes of the composite filament drawn yarns decreased and the pressure loss increased, according to the decrease of the diameter of the constricted portion of the conjugate spinning spinneret orifice. From its relationship with the pressure loss, the diameter of the constricted portion should be 0.20~0.45 mm, preferably 0.25~0.35 mm.

It is also understood that the composite filament yarns of the present invention is superior to the side-by-side type composite filament yarns, with respect to abrasion resistance and prevention of sticking of undrawn yarns.

EXAMPLE 3

The material yarn $Y_{12}$ for stockings obtained in Example 2 was knit into leg and foot portions with a 4 feeder hosiery knitting machine at a rotation rate of 900 r.p.m. The knitting operation was conducted without difficulties and the resulting stockings had a good quality. In contrast, the material yarns $Y_{17}$ having a large number of fisheyes could not be knitted with stability at the rotation rate of 900 r.p.m. due to the formation of barré caused by skip stitch, yarn breakage or fluctuation of knitting tension.

EXAMPLE 4

Using the material yarn $Y_{12}$ for stockings obtained in Example 2 and a bulky, texturized yarn of 13 d/3 f, stockings having leg and foot portions were knitted alternately with these yarns with a four feeder hosiery knitting machine (rotation rate of 600 r.p.m.). The resultant stockings were highly stretchable and excellent in transparency and had a beautiful appearance having very few defects.

What is claimed is:

1. A crimped filament yarn which comprises a filament having a polyamide sheath component and a polyurethane core component arranged eccentrically within said polyamide sheath component so that said polyamide sheath component has a thinnest portion, said polyurethane core component having a neck portion extending radially through the thinnest portion of said polyamide sheath component to the surface of the filament where it is exposed at a substantially uniform width of between 2% and 25% of the circumference of the filament and having a standard deviation about a mean value not exceeding 1.3%.

2. The composite filament yarn according to claim 1, wherein the polyurethane core component is exposed in a width of between 3% and 15% of the circumference of the filamet.

3. The composite filament yarn according to claim 1, wherein the polyamide component and polyuretnane component are combined in a ratio of between 40/60 and 80/20, by volume.

4. The composite filament yarn according to claim 1, wherein the polyamide component and polyurethane component are combined in a ratio of between 45/55 and 70/30, by volume.

5. The composite filament yarn according to claim 1, wherein said polyamide sheath component thinnest portion has a thickness of not more than 1/20 of the diameter of the filament and a width not exceeding 1/5 of the diameter of the filament.

6. A crimped composite filament drawn yarn which comprises a filament having a polyamide sheath component and a polyurethane core component arranged eccentrically within said polyamide sheath component so that said polyamide sheath component has a thinnest portion, said polyurethane core component extending radially through said polyamide sheath component to the surface of the filament where it is exposed at a substantially uniform width of between 2% and 25% of the circumference of the filament and having a standard deviation about a mean value not exceeding 1.3%, said drawn yarn not containing more than 1,000 fisheyes/kg of yarn and having a shrinkage in boiling water of about 5~30%.

7. The composite filament drawn yarn according to claim 6, which contains not more than 500 fisheyes/kg of yarn.

* * * * *